US007030827B2

(12) United States Patent
Mahler et al.

(10) Patent No.: US 7,030,827 B2
(45) Date of Patent: Apr. 18, 2006

(54) PLANAR ANTENNA AND ANTENNA SYSTEM

(75) Inventors: Wolfgang Mahler, Stuttgart (DE); Friedrich Landstorfer, Stuttgart (DE); Jürgen Motzer, Gengenbach (DE)

(73) Assignee: VEGA Grieshaber KG, (DE)

( * ) Notice: Subject to any disclaimer, the term of this patent is extended or adjusted under 35 U.S.C. 154(b) by 0 days.

(21) Appl. No.: 10/988,989

(22) Filed: Nov. 15, 2004

(65) Prior Publication Data

US 2005/0184920 A1 Aug. 25, 2005

Related U.S. Application Data

(63) Continuation of application No. PCT/EP03/05118, filed on May 15, 2003.

(60) Provisional application No. 60/381,235, filed on May 16, 2002.

(51) Int. Cl.
*H01Q 13/00* (2006.01)
*H01Q 9/28* (2006.01)

(52) U.S. Cl. ..... 343/772; 343/795

(58) Field of Classification Search ..... 343/795, 343/797, 803, 772, 786; H01Q 13/00, 9/28
See application file for complete search history.

(56) References Cited

U.S. PATENT DOCUMENTS 3,348,228 A 10/1967 Melancon
3,611,398 A 10/1971 Schnetzer
6,266,022 B1 7/2001 Müller et al.

FOREIGN PATENT DOCUMENTS

| | | |
|---|---|---|
| DE | 19800306 | 7/1999 |
| EP | 0935127 A2 | 8/1999 |
| WO | WO-02/31450 A1 | 4/2002 |

OTHER PUBLICATIONS

"International Search Report relating to PCT/EP 03/05118", (Aug. 8, 2003), 2 Pages.

*Primary Examiner*—Hoanganh Le
(74) *Attorney, Agent, or Firm*—Schwegman, Lundberg, Woessner & Kluth, P.A.

(57) ABSTRACT

The present invention relates to a planar antenna (1) for excitation of the TE01-mode of an electromagnetic wave and adapted to be arranged in a waveguide tube (2). The planar antenna comprises a substrate (6) of dielectric material having a first surface (7) intended to face towards a filling good surface and a second surface (8) facing in an opposite direction. A first group (9) of a plurality of dipole arms (10) is arranged on the first surface (7) or the second surface (8) on a perimeter of a circle with a predetermined radius. A second group (11) of a plurality of dipole arms (12) is arranged on the first surface (7) or the second surface (8) on the perimeter of the circle with the predetermined radius. The dipole arms (10) of the first group (9) extend in a first direction and the dipole arms (12) of the second group (11) extend in a direction opposite the first direction. Furthermore, the present invention relates to an antenna system comprising a cylindrical waveguide tube (2) having a bottom plate (3) and a tube portion (4) and a planar antenna (1) as mentioned above.

30 Claims, 6 Drawing Sheets

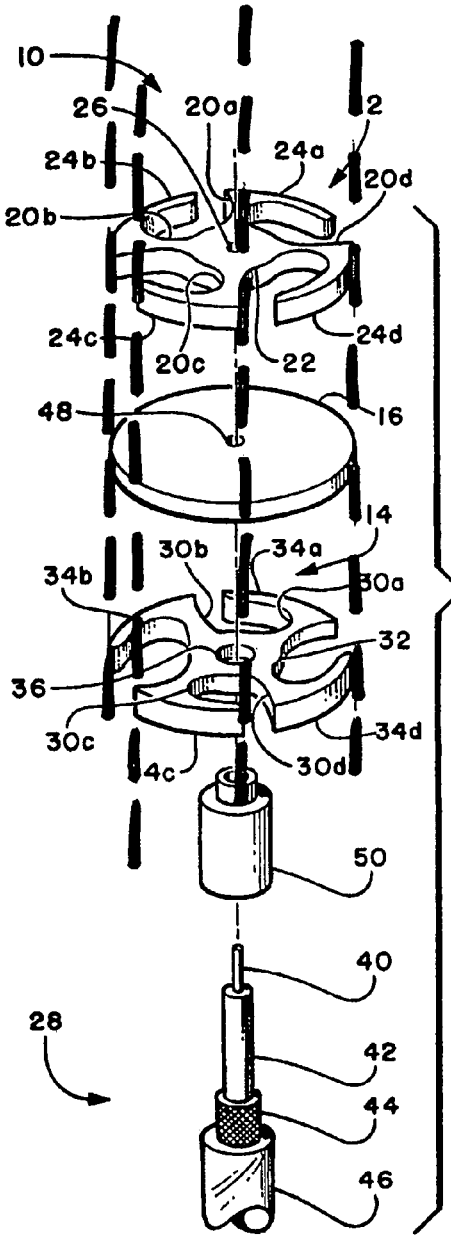
FIG. 1
FIG. 2
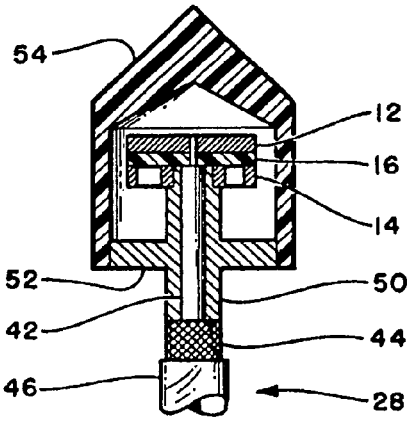
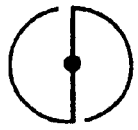
FIG. 3a
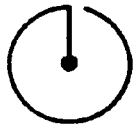
FIG. 3b
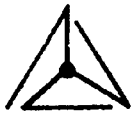
FIG. 3c

PLANAR ANTENNA AND ANTENNA SYSTEM

CROSS-REFERENCE TO RELATED APPLICATIONS

This application is a continuation under 35 U.S.C. 111(a) of PCT/EP03/05118, filed May 15, 2003, and published in English on Nov. 27, 2003 as WO 03/098168 A1, which claimed priority under 35 U.S.C. 119(e) of U.S. Provisional Application Ser. No.: 60/381,235, filed May 16, 2002, which applications and publication are incorporated herein by reference.

FIELD OF THE INVENTION

The invention relates to a planar antenna for exciting the $TE_{01}$-mode (also known as $H_{01}$-mode) and intended to be used in a filling level measuring device for determining a filling height of a filling good in a receptacle. The present invention relates furthermore to an antenna system adapted to be used in a tube, e.g. a bypass tube, for measuring the height of a filling good in a receptacle.

The "genuine radar method" (also called pulse radar method) and the "time domain reflectometry (TDR)-Method" generate electromagnetic waves or measuring signals which are transmitted in the direction of the surface of a medium or filling good and are at least partially reflected at the surface of the medium as so-called echo signals. The echo signals are detected and evaluated by means of a delay time method. These techniques are well known and, therefore, detailed explanations are omitted. These basic methods are, for example, explained in "Radar Level Measurement—The User's Guide", VEGA Controls, 2000, Devine, Peter (ISBN 0-9538920-0-X). Both the planar antenna and the antenna system according to the present invention are used for excitation of radar signals in radar level measurement applications based on the above-mentioned pulse radar method or the TDR-method.

BACKGROUND OF THE INVENTION

Level measurement by means of a radar is an elegant, precise and reliable method. This well-established technique uses, for example, horn antennas exciting the $TE_{11}$-fundamental mode (also known as $H_{11}$-mode) in the circular wave guide, propagated in bypass tubes. Horn antennas and the use of the fundamental $TE_{11}$-mode allow high resolution and high accuracy, but there are limitations due to the influence of the wall material of the measuring pipes. Level detection of products with a low relative permittivity or under extreme conditions (e.g. pressure or temperature) in industrial tanks often requires bypass pipes or stand pipes. The bypass holes may cause false echoes, disturb the measurement and may decrease the accuracy.

Hence, there is a need for an antenna system which can be used in tubes, for example, bypass tubes, for measuring the filling height of a filing good in a receptacle and which has at least an accuracy as can be achieved by usage of a horn antenna or an even better accuracy.

A level measuring device comprising a planar antenna is, for example, shown in WO 02/31450 A1. This planar antenna comprises a plurality of straight metallic portions extending radially from a center and having arms connected with the straight portions and extending tangentially on the perimeter of a circle. All arms extend in the same direction.

All these elements are arranged on the same surface of a substrate. It is outlined that such a structure would be advantageous with respect to the minimum clearance (also known as block distance) between the planar antenna and a free surface of a filling good of which the filling height is to be measured, because the disclosed planar antenna would reduce the block distance.

SUMMARY OF THE INVENTION

A planar antenna according to the invention for excitation of the $TE_{01}$-mode comprises a substrate of dielectric material having a first surface being intended for facing towards a filling good surface and a second surface facing in an opposite direction. A first group of dipole arms is arranged on the first surface or the second surface on a perimeter of a circle with a predetermined radius. A second group of dipole arms is arranged on the first surface or the second surface on a perimeter of the circle with the predetermined radius. The dipole arms of the first group extend in a first direction and the dipole arms of the second group extend in a direction opposite the first direction.

Due to the use of $TE_{01}$-mode, the arrangement of such a planar antenna in a tube may not involve the problems known from the use of horn antennas in such tubes. Furthermore, such a basic planar antenna design can be used for a center frequency of approximately 3 GHz up to 70 GHz or more, preferably for a center frequency of 26 GHz and more, but preferably around 20 GHz to 28 GHz.

It might be advantageous to use a mode converter which transforms a coaxial TEM-mode into a $TE_{01}$-mode in a circular wave guide, here a waveguide-tube.

In an exemplary embodiment of a planar antenna according to the invention, the first group of dipole arms and the second group of dipole arms are arranged on opposite surfaces of the substrate. In this case, it might be advantageous, that the first group of dipole arms is connected by a first connection element and the second group of dipole arms is connected with each other by a second common connection element. Both the first connection element and the second connection element may be shaped as a connection ring (star-point). The diameter of the second ring distinguishes from the diameter of the first ring. In a further exemplary embodiment of the invention the diameter of the second ring is greater than the diameter of the first ring. Both the first connection element and the second connection element may serve as an electrical contact to be contacted from the lower surface of the substrate. These connection elements enable contact with an outer and an inner conductor of a coaxial line.

In a further exemplary embodiment of the invention, the substrate has a predetermined thickness defined by the first surface and the second surface. In the case of an operating frequency of 26 GHz, the substrate has a thickness between 0.20 mm–0.30 mm. In a preferred embodiment, the substrate is OF RD-DUROID 5880 having ER=2.2 and tang (Q)=0.0009, the thickness is 0.254 mm.

In a further exemplary embodiment of the invention, the dipole arms have a length of $\lambda/4$. The dipoles are constantly arranged on the perimeter of a circle with a radius of 7.5 mm. The waveguide-tube has a diameter of 0.24 mm.

In a further exemplary embodiment of the invention, the dipole arms of the first group and of the second group have the same dimensions.

In a further exemplary embodiment of a planar antenna of the invention, each dipole arm of both the first group and the second group includes a first dipole connection portion extending radially and a second dipole portion extending tangentially. The first dipole portions might include a matching network. The network provides a two-stage transformation. Firstly, the reactive component of the input impedance of the dipole is compensated by a short transmission line. In a second step, a high and real input impedance is achieved by using a λ/4-transformer. In principle, there is also the possibility to use stubs, but it might disturb the absolute symmetry of the whole assembly contrary to the method described above. The input impedance of each dipole should be transformed to 600 Ω, or other values, in order to get an input impedance by the connection ring of 50 Ω. In reality, the connection ring input impedance is not transformed directly to 50 Ω, because physically it is not possible to realise a transmission line characteristic impedance of 600 Ω. Instead of this, the impedance is firstly transformed to 28.8 Ω. The final matching is done by the coaxial line transformer described in the following.

The overall transformation to an input impedance of 50 Ω is done by a coaxial line transformer. This transformer is realised with a semi rigid cable with polytetraflouethylene, e.g., Teflon™, as dielectric (for example RG 402, product name UT 141-A-TP and a characteristic impedance of 50 Ω). This line migrates into an airline of the length L2, followed by a A/4 (air-) transformer to obtain the matching of the connection ring impedance of 28.8 Ω.

The fabrication of a modified inner conductor might be extremely difficult due to the small dimensions, so the diameter of the inner conductor is not changed. The characteristic impedance of the line transformer is calibrated by the inner diameter of the outer conductor.

Therefore, the matching network for each dipole may comprise a first length portion having a first width, a second length portion having a second width and a third length portion having a third width. The first length portion is contacted with the dipole arms, the third length portion is connected with the connection ring.

In a further exemplary embodiment of a planar antenna according to the invention each dipole arm of the first group and the second group is bent according to the perimeter of a circle. Hence, the dipole arms follow accurately the ring-shaped electrical flux line of the field pattern of the $TE_{01}$-mode in a cylindrical waveguide-tube. In an alternative embodiment, each dipole arm of both the first and second group is shaped as a straight line. Both the bent dipole arms and the straight dipole arms preferably have a length of about a quarter of the wavelength to be excited, more preferably a shorter wave length.

Due to easier manufacturing, in an exemplary embodiment of a planar antenna according to the present invention the first group of dipole arms and the second group of dipole arms are arranged on different surfaces of the substrate. Hence, the first group of dipole arms may be arranged on the upper surface intended to face towards the filling good, and the second group of dipole arms is arranged on the lower surface of the substrate intended to face towards a bottom plate of a waveguide-tube. Such an arrangement of dipole arms allows the arrangement a relatively high number of dipole arms on each surface without the problem that the excitation structures come too close to one another. Furthermore, a central feeding may be provided for the first group of dipole arms and for the second group of dipole arms. A feeding might be provided by a first connection element from which dipole arm connection portions extend up to the dipole arms. A second connection element may be provided on the other surface of the substrate to connect the dipole arms of the other group.

In a further exemplary embodiment of a planar antenna according to the invention, both the first group and the second group of a plurality of dipole arms are manufactured in a micro-strip-line-technique.

In a further exemplary embodiment of a planar antenna according to the present invention dipole arm connection portions as well as matching networks and each connection ring on each surface of the substrate are manufactured in a microstrip-line-technique.

As already mentioned above, according to a further aspect of the present invention, an antenna system comprises a cylindrical waveguide-tube having a bottom plate and a tube portion. A planar antenna intended for excitation of a $TE_{01}$-mode and arranged in the cylindrical waveguide-tube includes at least a substrate of dielectric material, a first group of a plurality of dipole arms arranged on a perimeter of a circle with a predetermined radius, a second group of a plurality of dipole arms arranged on a perimeter of the circle with a predetermined radius. The dipole arms of the first group extend in a first direction and the dipole arms of the second group extend in a direction opposite to the first direction. The second surface of the planar antenna is arranged parallel to and in a distance to the bottom plate such that a spacing is provided.

In an exemplary embodiment of an antenna system according to the present invention, a balun network is inserted between an unsymmetrical coaxial line and both the first group of the plurality of dipole arms and the second group of a plurality of dipole arms. The coaxial line serves as a feeding for the excitation structure of the planar antenna. The balun network avoids sheath-waves. Such a balun network may comprise a first ring terminal and a second ring arranged coaxially inserted within the first ring terminal. The inner conductor of the coaxial line runs within the second terminal. The height of the first terminal is approximately λ/4. By connecting the symmetrical antenna between both mentioned terminals, sheath-waves can be neglected in the λ/4-transformer. The diameter of the bazooka balun is chosen to the double diameter of the outer connector of the coaxial lines as a rule of thumb. The balun functions as a coaxial trap.

In a further exemplary embodiment of the antenna system according to the present invention, the spacing between the bottom plate of the waveguide tube and the second surface of the substrate is partly or completely filled with at least one dielectric material. The dielectric material may be Teflon, PTFE or Rohacell. Due to the dielectric material partly or completely filling the spacing, the strength of the whole assembly is improved.

In a further exemplary embodiment of the antenna system according to the present invention, a covering layer is provided on or in front of the first surface of the substrate. The covering layer comprises at least one dielectric material. Due to such a covering layer, protection against the atmosphere in the waveguide-tube or bypass-tube is fulfilled. Furthermore, due to the shaping of the outer face of the covering layer, a lens effect may be achieved. Such a covering layer will interact with the structure, therefore, this has to be considered when designing the planar structure.

In an alternative embodiment of an antenna system according to the present invention, the covering layer may be arranged within the waveguide-tube in such a manner that a spacing is provided between the covering layer and the first surface of the substrate.

As mentioned above, the covering layer may have a convex or concave shape.

It is to be noted that the antenna system according to the present invention may comprise a planar antenna with at least one or more features mentioned above.

BRIEF DESCRIPTION OF THE INVENTION

FIG. 1 is a schematic cross section of an exemplary embodiment of an antenna system according to the present invention;

FIG. 2 is a schematic cross section of a Bazooka balun;

FIG. 3 is a perspective view of the Bazooka balun of FIG. 2;

DESCRIPTION OF EXEMPLARY EMBODIMENTS OF THE INVENTION

Figure 4:
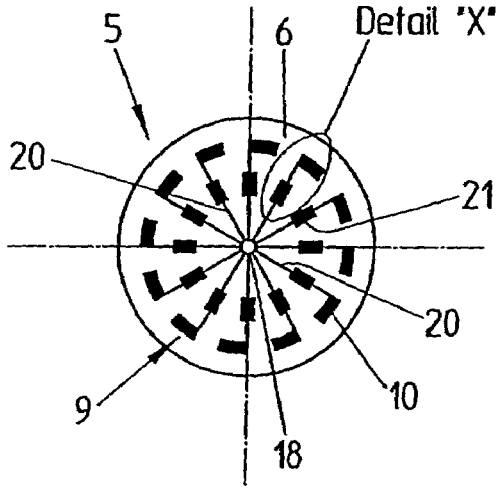
FIG. 4 is a plan view of an exemplary embodiment of a planar antenna according to the present invention, wherein a first surface of a substrate with a first group of a plurality of dipole arms is shown.

FIG. 1 shows a schematic cross section of a first exemplary embodiment of an antenna system 1 according to the present invention. The antenna system 1 comprises a cylindrical waveguide-tube 2 having a bottom plate 3 and a tube portion 4. The antenna system 1 further comprises a planar antenna 5 intended for excitation of a $TE_{01}$-mode of an electromagnetic wave. The planar antenna 5 is arranged in the cylindrical waveguide 2.

The planar antenna 5 includes a substrate 6 of a dialectic material having a first surface 7 intended to face towards a filling good surface and a second surface 8 facing in an opposite direction. The second surface 8 faces to the bottom plate 3 of the waveguide-tube 2. On the first surface 7 of the substrate 6 of dielectric material, here RT-Duroid 5880, a first group 9 of a plurality of the dipole arms 10 is arranged. A second group 11 of a plurality of dipole arms 12 is arranged on the second surface 8 of the substrate 6. For further details with respect to the structure and shape of the first and second group 9, 11 of a plurality of dipole arms 10, 12, we refer to the explanations below given with respect to FIG. 4–6 and 8.

The planar antenna 5 is arranged in the waveguide-tube 2 such that the substrate 6, in particular the second surface 8 of the substrate 6, is parallel with the bottom plate 3 of the waveguide-tube 2. The clearance space between the second surface 8 and the substrate 6 and the bottom plate 3 can be filled partly or completely with a dielectric material, as, for example, polytetraflouethylene (PTFE), e.g., Teflon™, or the like. The distance between the second surface 8 of the substrate 6 and the bottom plate 3 is about a quarter of the electromagnetic wave to be excited by the inventive planar antenna 5.

As shown in FIG. 1, the excitation structures on the first surface 7 of the substrate 6 and the second surface 8 contact a balun network 100 as is shown in FIGS. 2 and 3. The balun network is connected with a coaxial cable 13. With the coaxial cable 13 an unsymmetrical signal is fed to the planar antenna 5. The balun network 100 is necessary to avoid sheath-waves. The balun network 100 comprises a ring-shaped terminal 15 and a further ring-shaped second terminal 16. In FIGS. 2 and 3 the core 17 of the coaxial cable 13 is shown, too. Such a balun network 100 acts as a coaxial trap. The $\lambda/4$-line, which is opened between the terminals 15 and 16, shows in the "loss less case" at the set frequency an infinite impedance. By connecting the symmetrical antenna between terminal 16 and the center line of the coaxial cable 17, sheath-waves can be neglected in the band of the $\lambda/4$-transformer. The diameter of the bazooka balun 100 is chosen to the double diameter of the outer connector of the coaxial line, as a rule of thumb.

As is shown in FIG. 1, the terminal 16 of the bazooka balun network 100 contacts a connection ring 19. The connection ring 19 itself is connected with all dipole arm connection portions 21 extending basically radially to the dipole arms 12 on the lower surface 8 of the substrate 6. The core 17 of the coaxial cable 13 connect with a connection ring 18. The connection ring 18 itself is connected with all dipole arm connection portions 20 extending basically radially to the dipole arms 10 arranged on the upper surface 7 of the substrate 6.

Furthermore, the outer terminal 15 of the bazooka balun 100 has a predetermined height, the height being approximately $\lambda_0/4$. This outer terminal 15 is connected with the bottom plate 3 (short) of the waveguide-tube. The outer terminal 15 has no contact with the substrate 6 or the metallic structures arranged thereon.

It has to be noted that the substrate 6 is arranged in the waveguide-tube 2 such that the lower surface 8 of the substrate 6 is parallel with the bottom plate 3 of the waveguide tube. The distance between the lower surface 8 and the bottom plate 3 is about $\lambda/4$. The spacing between the substrate 6 and the bottom plate 3 might be filled partly or completely with a dielectric material, as, for example, Teflon, PDFE or the like.

In FIG. 4, a planar view of the planar antenna 5 according to the invention is shown. Here, the upper surface 7 is intended to face towards a filling good. The planar antenna 5 comprises 12 dipole arms 10 arranged on a perimeter of a circle. Here, the circle has a diameter of 15 mm. The dipole arms 10 have a length of about $\lambda/4$ and are bent according to the perimeter of the circle. In a center area of the substrate 6, a hole is provided coaxially with the connection ring 18. The connection ring 18 serves to connect with the center line 17 of the coaxial cable 13. Each dipole arm 10 has a dipole connection portion 20 extending radially from the connection ring 18. The connection portion 20 connects the connection ring 18 with the dipole arm 10. Each connection portion 20 comprises a matching network 21 as is shown in more detail in FIG. 6.

Figure 5:
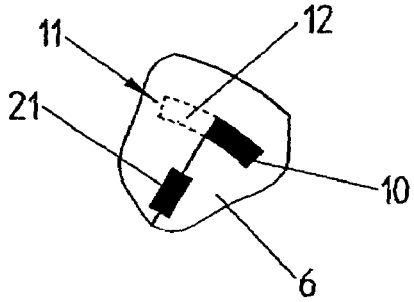
FIG. 5 is, in enlarged scale, a plan view of a detail of a dipole arm as shown in FIG. 4, wherein a dipole arm on a second surface of the substrate of FIG. 4 is indicated.
Figure 6:
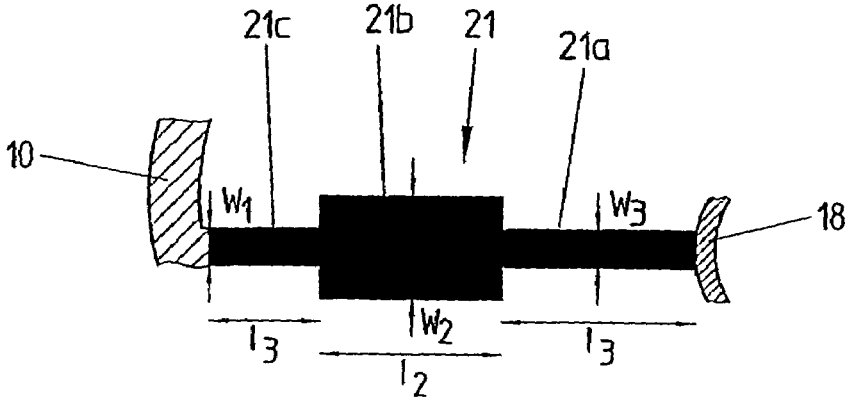
FIG. 6 is a detail "X" of the plan view of the planar antenna of FIG. 4 showing a matching network of a dipole connection portion of a dipole arm.

FIG. 5 shows a detail "X" of FIG. 4. A dipole arm 12 is arranged on the lower surface 8 of the substrate 6 as is indicated. This dipole arm 12 extends in an opposite direction as a dipole arm 10. The dipole arm 12 also comprises a dipole arm connection portion 21 which is connected with a connection ring 19, as is already shown in FIG. 1. These dipole arm connection portions 21 on the lower surface 8 of the substrate 6 comprise a matching network 21, as is shown in FIG. 6. The dimensions of the dipole arms 10 and 12 as well as of the connection portions 20, 21 are identical. Bach connection arm 10 and an accompanying dipole arm 12 function as a dipole half. Hence, the planar antenna 5 according to the invention as shown in the above-mentioned figures comprises twelve dipoles. The number of the dipoles may vary. It might be possible to arrange only four or five or ten dipoles on each surface 7, 8 of the substrate 6. However, it might also be possible to arrange more than twelve dipoles on each surface 6, 7.

As shown in FIG. 6, a matching network 21 comprises three different shaped transmission lines 21*a*, 21*b*, 21*c*. These three different transmission lines have different widths W1, W2, W3 and three different lengths L1, L2, L3. The total length ($L_1$+$L_2$+$L_3$) may be identical with the length of a dipole connection portion 20. The matching network for the excitation structure is used due to the high mode purity of the present structure. The matching network 21 was designed on the basis of the calculated input impedance of the dipoles. The matching network 21 provides a two-stage transformation. Firstly, the reactive component of the input impedance of the dipole is compensated by a short transmission line 21*c*. In a second step, a high and real impedance is achieved by using a λ/4-transformer 21*b*. In principle, there is also the possibility to use stubs, but they would disturb the absolute symmetry of the whole assembly. There might also be problems with the fabrication.

Figure 7:
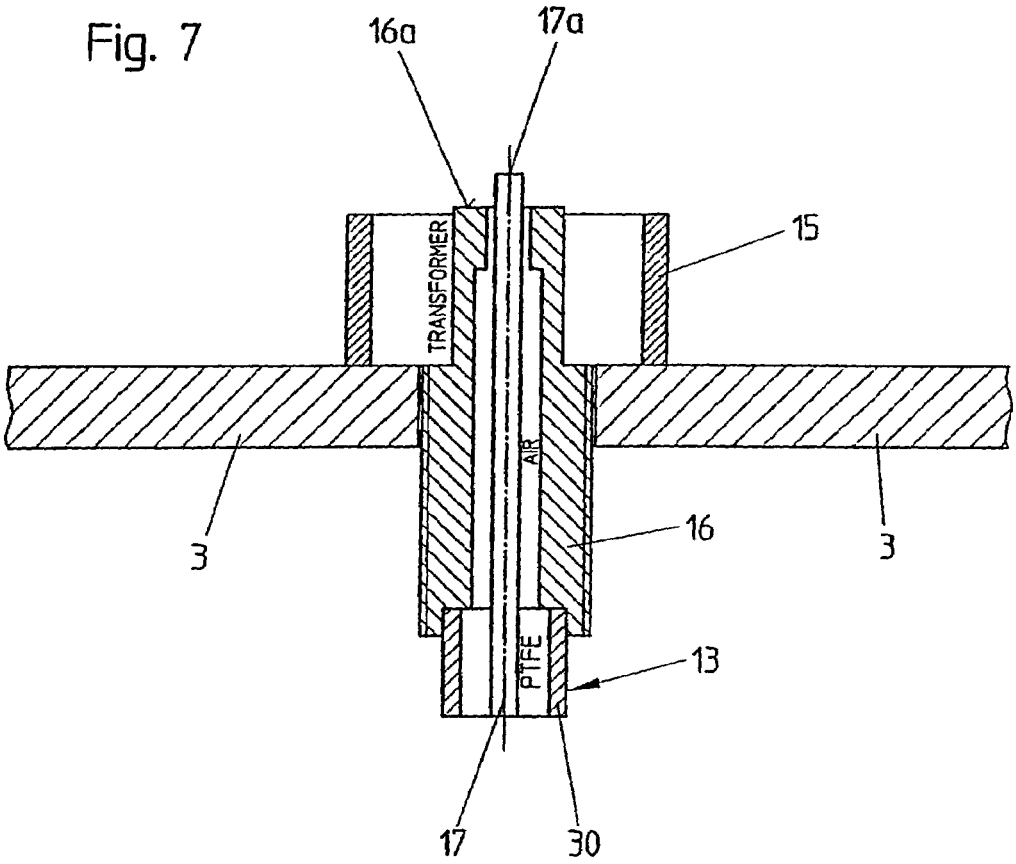
FIG. 7 is a cross section of the assembly shown in FIG. 1.
Figure 8:
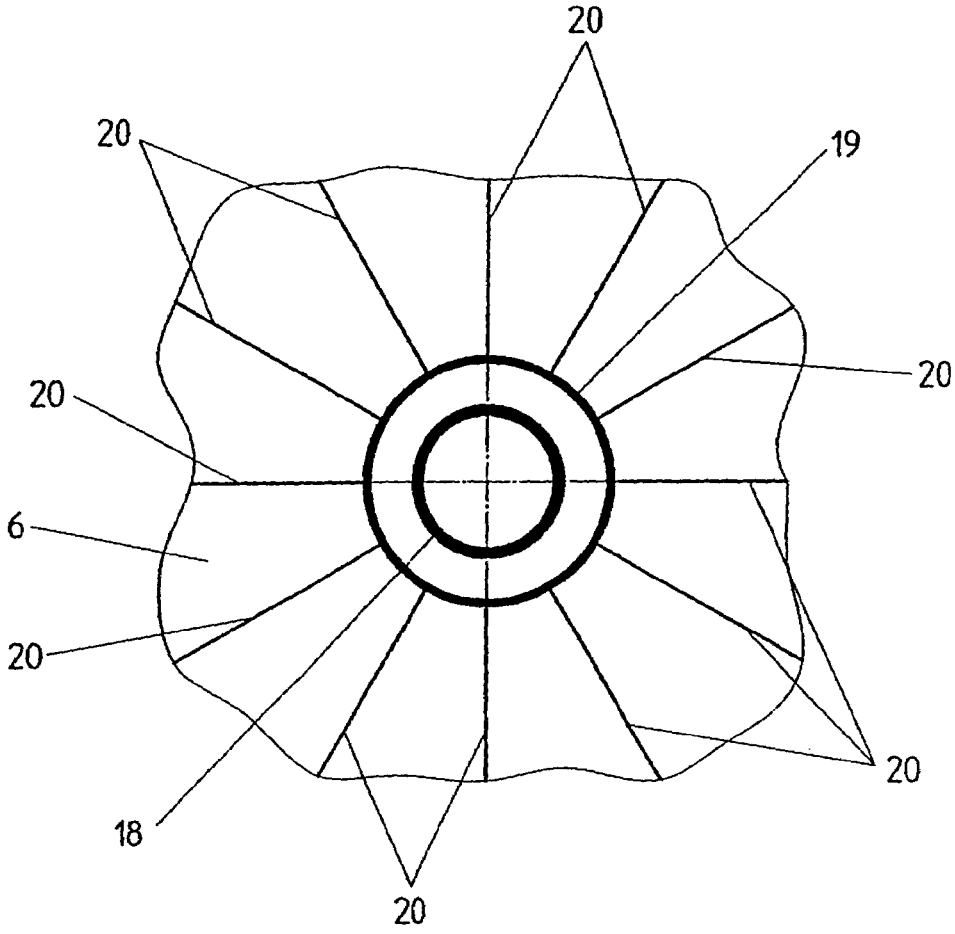
FIG. 8 is a plan view of a detail of the planar antenna of FIG. 4 showing the second surface of the substrate of the planar antenna.

As already mentioned, all dipole aim connection portions 20 function as a matching network 21 due to the above-mentioned shape and shunt to a common connection ring 18 in the center of the substrate 6. This connection ring 18 may also be called star-point. Here, the input impedance of each dipole should be transformed to 600 Ω, in order to get an overall input impedance at the connection ring 18 of 50 Ω. In reality, the connection ring 18 input impedance is not transformed directly to 50 Ω, because physically it is not possible to realize a transmission line characteristic impedance of 600 Ω. Instead, the impedance is firstly transformed to 28,8 Ω. The final matching is done by a coaxial line transformer. This transformer is realized with a semi-ridged cable with Teflon as a dielectric and a characteristic impedance of 50 Ω. This line migrates into an airline of the length of λ/2 followed by a λ/4 λ(air) transformer to obtain the matching of the common connection ring 18 impedance of 28,8 Ω. The characteristic impedance of the line transformer is calibrated by the inner diameter of the outer conductor. In FIG. 7, the geometry of this coaxial transformer is shown.

As it is easier to realize the transmission of the coaxial line transformer to the micro-strip-line structure, the excitation structure is distributed on both sides of the substrate 6. On each side 7, 8 of the substrate 6, there is one group of dipole arms 10, 12. The matching network 21 is also realized on both surfaces 7, 8 and is constructed in such a manner, that this structure on the upper and lower surface 7, 8 of the substrate 6 is overlapping, in accordance with a symmetrical transmission line. Additionally, the structure has the advantage that the characteristic impedance of the lines of the matching network 21 can be easily and precisely adjusted. This excitation structure shows a good $TE_{01}$-mode purity in the far field, so this stucture becomes also a good candidate for the realization. The real part of the input impedance of each dipole is a little bit lower than with the structure on only one side of this substrate. The matching network has to be adjusted accordingly.

As already mentioned, FIG. 7 shows a transmission line as used in FIG. 1. This transmission line comprises a coaxial line 13 having a center line 17 and an outer line 30. The outer line 30 connects with a bush 16 having an outer thread for matching with an inner thread of a center hole in the bottom plate 3 of the waveguide-tube 2. A ring 15 is arranged above the bottom plate 3 to function in connection with the bush 16 as a balun network mentioned above. The bush 16 has a connection side 16*a* to be connected with the connection ring 18 of the metallic micro strip structure on the lower surface 8 of the substrate 6. The center line 17 of the coaxial cable 13 has a connection side 17*a* to be connected with a connection ring 18 of the metallic excitation structure on the upper side of the substrate 6.

Here, a ring of dipoles with twelve radiators, with displaced half dipoles and a symmetrical feeding on the upper side and lower side of the substrate 6, was built with the following data.

| geometry | width in mm | length in mm | impedance |
|---|---|---|---|
| Single dipole | 0.5 | 1.44 | 46.5 − j106 'Ω |
| Feed line | 0.1 | 0.595 | 43.1 'Ω |
| Impedance transformer | 0.41 | 2.1 | 260.7 + j15.2 'Ω |
| One single arm | | | 186.3 + j24.4 'Ω |
| All twelve arms | | | 27.8 + j3.7 'Ω |

As mentioned above, the diameter of the waveguide tube 2 was chosen to 24 mm, in order to prevent the possibility of the propagation of the $TE_{02}$-mode.

FIG. 8 shows again a more detailed view of the center area of the substrate 6 with the connection ring 18 and the connection ring 19. The connection ring 18 is arranged on the upper surface 7 of the substrate 6, the common connection ring 19 is arranged on the lower surface 8 of the substrate 6. Hence, if the connection face 17*a* of the inner line of the coaxial cable 13 connects with the connection ring 18, the connection face 16*a* of the bush 16 connects with the connection ring 19.

Figure 9:
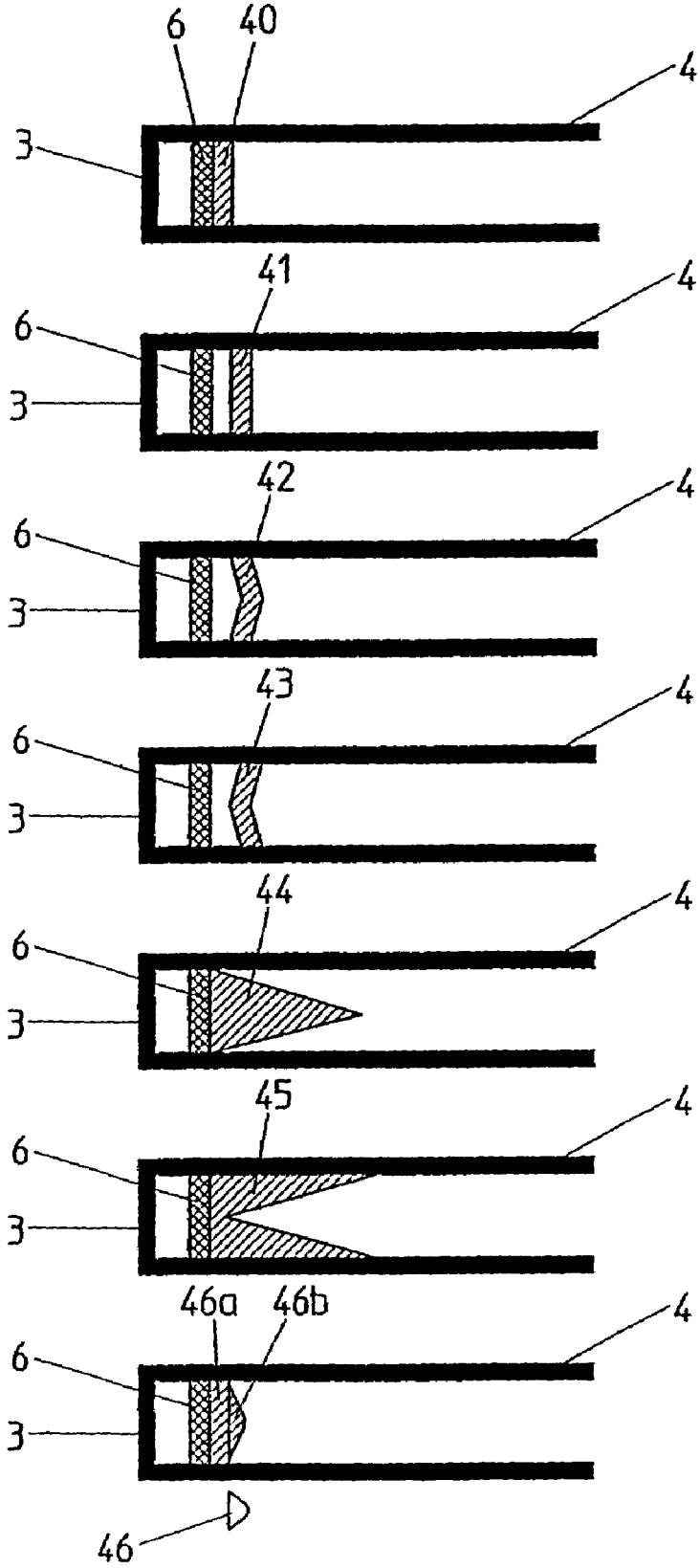
FIG. 9 shows various exemplary embodiments of a coating layer in front of the first surface of the substrate of a planar antenna as for example shown in FIG. 4.

In FIG. 9, several various embodiments of an antenna system according to the invention are shown. For simplification of the drawings, only the substrate 6 and the waveguide-tube 2 are shown. In the first exemplary embodiment of the invention, a covering layer 40 is provided directly on the substrate 6. The covering layer 40 is of a dielectric material. In the second embodiment, a covering layer 41 is arranged at a distance to the substrate 6. The third and fourth exemplary embodiments show a covering layer 42, 43 arranged at a distance to the substrate 6 but having a convex or conical shape.

The fifth and sixth embodiment of the present invention show a covering layer 44 and 45 arranged on the substrate 6. Again, the covering layers 44, 45 have a conical or convex shape.

The last embodiment comprises a covering layer 46 including two or more different layers 46*a*, 46*b*. The outer layer 46*b* has a convex or concave shape.

The material of the covering layer has to be a dielectric material, as, for example, PTFE. The thickness of such a layer may be approximately λ/4 or n×λ/4, wherein n∈N.

Figure 10:
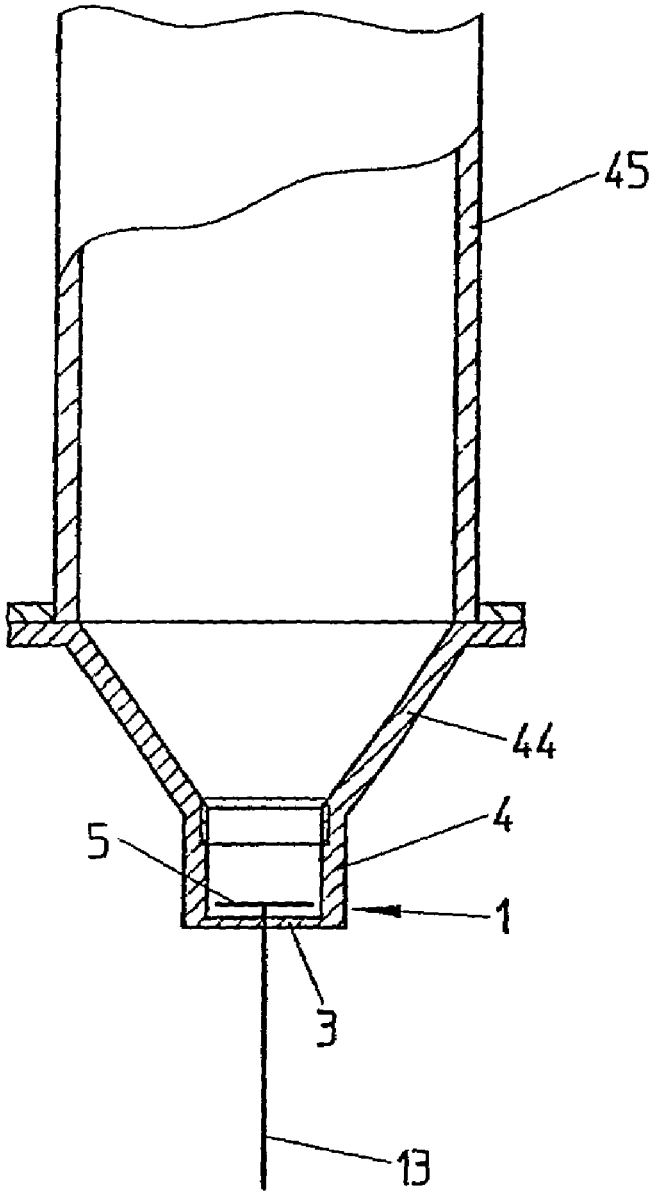
FIG. 10 is a schematic cross section of an exemplary embodiment of an antenna system according to the invention, provided with a taper for matching purposes.

Finally, we refer to FIG. 10 showing a schematic cross section of an antenna system 1 according to the present invention. Here, the planar antenna 5 is arranged as mentioned above within the waveguide-tube 4. A bypass-tube 45 is connected with the waveguide-tube 4 by a taper 44. The taper serves to match the inventive antenna system 1 with the bypass-tube 45 having a diameter larger than the diameter of the waveguide-tube 4.

If the diameter of the bypass-tube 45 has a diameter less than the diameter of the waveguide-tube 4, a narrowing taper or a conical taper can be inserted between the waveguide-tube 4 and the bypass-tube 45.

A semi-rigid cable RG 402 UT 141-A-TP can be used to connect with an antenna system 1 according to the invention. The planar antenna system according to the invention for excitation of the $TE_{01}$-mode shows a good matching. An increasing or decreasing of the diameter of the waveguide, either by a step discontinuity or conical taper, cannot, in principle excite higher order modes. It might even be advantageous to reduce the diameter of the waveguide to avoid excitation of higher order modes.

Another possibility to evaluate the mode purity can be achieved by means of an analysis of the standing waves and of the resulting amplitude fluctuations, caused by this superposition of all excited modes. This is at least qualitatively possible, by connecting the planar antenna to a long waveguide-tube with a variable short having the same diameter.

All documents and publications mentioned herein are incorporated by reference for any purpose.

The invention claimed is:

1. An antenna system, comprising:

a cylindrical waveguide tube having a bottom plate and a tube portion;

a planar antenna adapted for exciting a $TE_{01}$-mode and arranged in the cylindrical waveguide-tube, wherein the planar antenna includes:

a substrate of dielectric material having a first surface intended to face towards a filling good surface and a second surface facing in an opposite direction, wherein the second surface of the planar antenna is arranged parallel to and at a distance to the bottom plate such that a spacing is provided;

a first group of a plurality of dipole arms arranged on the first surface or the second surface on a perimeter of a circle with a predetermined radius, wherein the dipole arms of the first group extend in a first direction;

a second group of a plurality of dipole arms arranged on the first surface or the second surface on the perimeter of the circle with the predetermined radius, wherein the dipole arms of the second group extend in a direction opposite the first direction.

2. The antenna system according to claim 1, wherein the first group of dipole arms and the second group of dipole arms are connected with an unsymmetrical coaxial line.

3. The antenna system according to claim 2, wherein a balun network is inserted between the unsymmetrical coaxial line and both the first group of a plurality of dipole arms and the second group of a plurality of dipole arms.

4. The antenna system according to claim 1, wherein the spacing between the bottom plate of the waveguide tube and the second surface of the substrate is partly or completely filled with at least one dielectric material.

5. The antenna system according to claim 1, wherein the at least one dielectric material is selected from the group comprising polytetrafluoroethylene, a polymer of fluorinated ethylene and polymethacrylimide-hard foam.

6. The antenna system according to claims 1, wherein a covering layer is provided on or in front of the first surface of the substrate, and the covering layer comprises at least one dielectric material.

7. The antenna system according to claim 6, wherein the at least one dielectric material of the covering layer is selected from the group comprising polyetrafluoroethylene, a polymer of fluorinated ethylene and polymethacrylimide-hard foam.

8. The antenna system according to claim 6, wherein the covering layer is arranged within the waveguide tube such that a spacing is provided between the covering layer and the first surface of the substrate.

9. The antenna system according to claim 6, wherein the covering layer has a convex or concave shape.

10. The antenna system according to claim 6, wherein the covering layer comprises two or more different dielectric layers.

11. The antenna system according to claim 1, wherein the substrate has no surface-wave excitation.

12. The antenna system according to claim 1, wherein the dipole arms of the first group and the dipole arms of the second group have the same dimensions.

13. The antenna system according claim 1, wherein each dipole arm of both the first group and the second group has a length about or less than a quarter of the wavelength of the electromagnetic wave.

14. The antenna system according to claim 1, wherein each dipole arm of the first group is provided with a dipole connection portion extending basically radially from a center area of the substrate and each dipole arm of the second group is provided with a dipole connection portion extending basically radially from the center area of the substrate.

15. The antenna system according to claim 14, wherein the dipole connection portions of the dipole arms of the first group are connected with a first common connection element, and the dipole connection portions of the dipole arms of the second group are connected with a second common connection element.

16. The antenna system according to claim 15, wherein at least one of the first common connection element and the second common connection element is shaped as a connection ring.

17. The antenna system according to claim 16, wherein the first common connection ring has a first diameter and the second common connection ring has a second diameter, the second diameter is smaller than the first diameter.

18. The antenna system according to claim 14, wherein each dipole connection portion includes a matching network.

19. The antenna system according to claim 1, wherein a first matching network is arranged between the first group of a plurality of dipole arms and a first feeding and a second matching network is arranged between the second group of a plurality of dipole arms and the first feeding or a second feeding.

20. The antenna system according to claim 19, wherein the matching network comprises a plurality of different shaped line portions.

21. The antenna system according to claim 19, wherein each matching network comprises a first line portion having a first width, a second line portion having a second width, and a third line portion having a third width.

22. The antenna system according to claim 21, wherein each first, second and third line portion has a different length.

23. The antenna system according to claim 1, wherein each dipole arm of both the first and the second group extends basically tangentially to the perimeter of the circle.

24. The antenna system according to claim 1, wherein each dipole arm of the first group and of the second group is bent according to the perimeter of the circle.

25. The antenna system according to claim 1, wherein each dipole arm of the first group and of the second group is shaped as a straight line.

26. The antenna system according to claim 1, wherein the first group of dipole arms and the second group of dipole arms are arranged on different surfaces of the substrate.

27. The antenna system according to claim 1, wherein the substrate has a predetermined thickness defined by the first surface and the second surface, the thickness being approximately about or somewhat thicker than a quarter wavelength of the electromagnetic wave in the substrate.

28. The antenna system according to claim 1, wherein the substrate has a low permittivity with $\epsilon_r<4$.

29. The antenna system according to claim 1, wherein the first group of a plurality of dipole arms and the second group of a plurality of dipole arms are manufactured in a micro-strip-line-technique.

30. The antenna system of claim 1, wherein each dipole arm of the first group is provided with a dipole connection portion extending basically radially from a center area of the substrate, wherein each dipole arm of the second group is provided with a dipole connection portion extending basically radially from the center area of the substrate, and wherein the dipole connection portions of the first group coincide with the dipole connection portions of the second group, so that the dipole arms of the fist group are staggered with respect to with the dipole connection portions of the first group.

* * * * *

UNITED STATES PATENT AND TRADEMARK OFFICE

CERTIFICATE OF CORRECTION

PATENT NO. : 7,030,827 B2
APPLICATION NO. : 10/988989
DATED : April 18, 2006
INVENTOR(S) : Mahler et al.

It is certified that error appears in the above-identified patent and that said Letters Patent is hereby corrected as shown below:

The title page showing the illustrative figure should be deleted to be replaced with the attached title page.

The drawing sheet, consisting of Figs. 1-3c, should be deleted to be replaced with the drawing sheet, consisting of Figs. 1-3, as shown on the attached page.

(12) United States Patent
Mahler et al.

(10) Patent No.: US 7,030,827 B2
(45) Date of Patent: Apr. 18, 2006

(54) PLANAR ANTENNA AND ANTENNA SYSTEM

(75) Inventors: Wolfgang Mahler, Stuttgart (DE); Friedrich Landstorfer, Stuttgart (DE); Jürgen Motzer, Gengenbach (DE)

(73) Assignee: VEGA Grieshaber KG, (DE)

( * ) Notice: Subject to any disclaimer, the term of this patent is extended or adjusted under 35 U.S.C. 154(b) by 0 days.

(21) Appl. No.: 10/988,989

(22) Filed: Nov. 15, 2004

(65) Prior Publication Data

US 2005/0184920 A1 Aug. 25, 2005

Related U.S. Application Data

(63) Continuation of application No. PCT/EP03/05118, filed on May 15, 2003.

(60) Provisional application No. 60/381,235, filed on May 16, 2002.

(51) Int. Cl.
*H01Q 13/00* (2006.01)
*H01Q 9/28* (2006.01)

(52) U.S. Cl. ..... 343/772; 343/795

(58) Field of Classification Search ..... 343/795, 343/797, 803, 772, 786; H01Q 13/00, 9/28
See application file for complete search history.

(56) References Cited

U.S. PATENT DOCUMENTS 3,348,228 A 10/1967 Melancon
3,611,398 A 10/1971 Schnetzer
6,266,022 B1 7/2001 Müller et al.

FOREIGN PATENT DOCUMENTS

| | | |
|---|---|---|
| DE | 19800306 | 7/1999 |
| EP | 0935127 A2 | 8/1999 |
| WO | WO-02/31450 A1 | 4/2002 |

OTHER PUBLICATIONS

"International Search Report relating to PCT/EP 03/05118", (Aug. 8, 2003), 2 Pages.

*Primary Examiner*—Hoanganh Le
(74) *Attorney, Agent, or Firm*—Schwegman, Lundberg, Woessner & Kluth, P.A.

(57) ABSTRACT

The present invention relates to a planar antenna (1) for excitation of the TE01-mode of an electromagnetic wave and adapted to be arranged in a waveguide tube (2). The planar antenna comprises a substrate (6) of dielectric material having a first surface (7) intended to face towards a filling good surface and a second surface (8) facing in an opposite direction. A first group (9) of a plurality of dipole arms (10) is arranged on the first surface (7) or the second surface (8) on a perimeter of a circle with a predetermined radius. A second group (11) of a plurality of dipole arms (12) is arranged on the first surface (7) or the second surface (8) on the perimeter of the circle with the predetermined radius. The dipole arms (10) of the first group (9) extend in a first direction and the dipole arms (12) of the second group (11) extend in a direction opposite the first direction. Furthermore, the present invention relates to an antenna system comprising a cylindrical waveguide tube (2) having a bottom plate (3) and a tube portion (4) and a planar antenna (1) as mentioned above.

30 Claims, 6 Drawing Sheets

Fig. 1

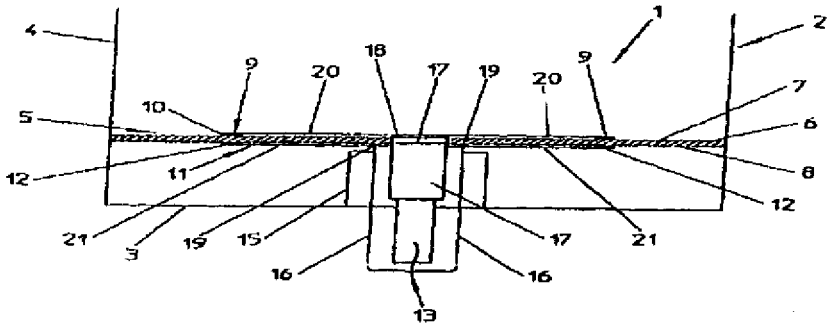

UNITED STATES PATENT AND TRADEMARK OFFICE

CERTIFICATE OF CORRECTION

PATENT NO. : 7,030,827 B2 
APPLICATION NO. : 10/988989
DATED : April 18, 2006
INVENTOR(S) : Mahler et al.

It is certified that error appears in the above-identified patent and that said Letters Patent is hereby corrected as shown below:

In the drawing:

On Sheet 1 of 6, delete

"

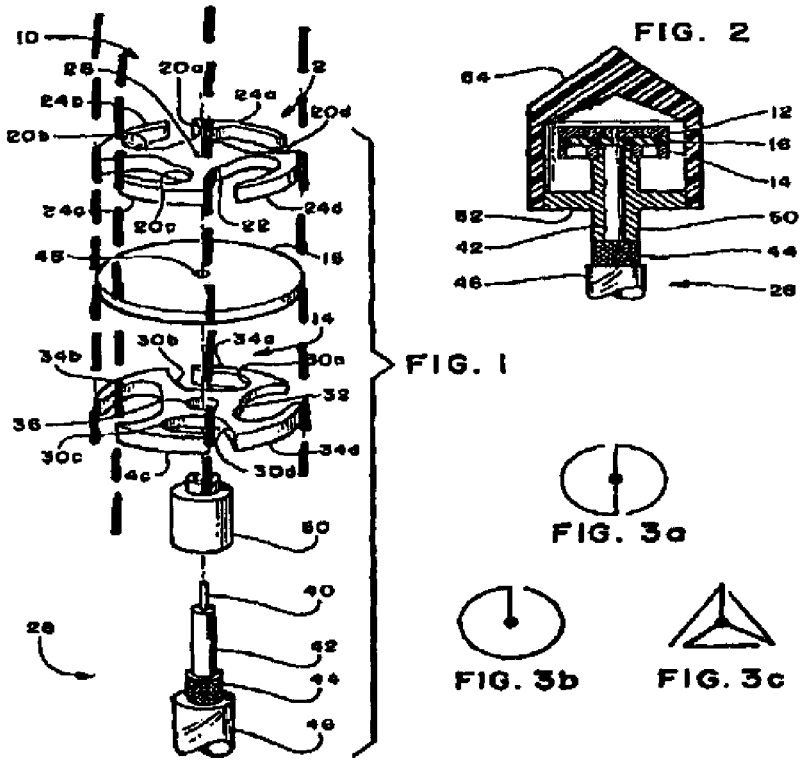

"

UNITED STATES PATENT AND TRADEMARK OFFICE

CERTIFICATE OF CORRECTION

PATENT NO. : 7,030,827 B2
APPLICATION NO. : 10/988989
DATED : April 18, 2006
INVENTOR(S) : Mahler et al.

It is certified that error appears in the above-identified patent and that said Letters Patent is hereby corrected as shown below:

and insert

Fig. 1

--

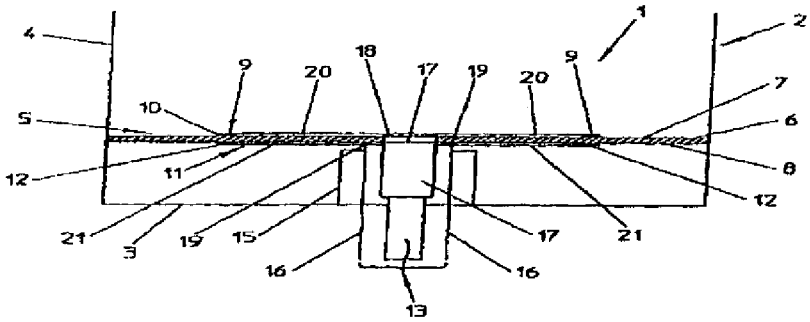

--,

Fig. 2

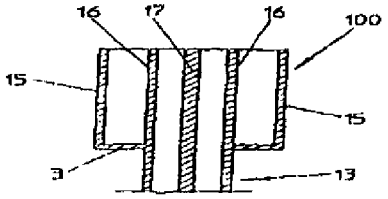

Fig. 3

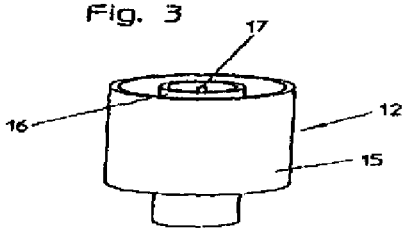

therefor.

Signed and Sealed this

Seventh Day of April, 2009

John Doll

JOHN DOLL
*Acting Director of the United States Patent and Trademark Office*